US005575161A

United States Patent [19]

Hinchey

[11] Patent Number: 5,575,161

[45] Date of Patent: Nov. 19, 1996

[54] DICE AND CRAPS STICK JEWELRY

[76] Inventor: Janet L. Hinchey, Rt. 3, Box 530, Colfax, La. 71417

[21] Appl. No.: 352,522

[22] Filed: Dec. 7, 1994

[51] Int. Cl.[6] ..... A44C 5/00; A44C 25/00

[52] U.S. Cl. ..... 63/2; 63/3; 63/15; 63/18; 63/20; D11/1; D11/2; D11/3

[58] Field of Search ..... 63/1.1, 2, 3, 7, 63/31, 15, 20, 23; D11/1–5; 273/146

[56] References Cited

U.S. PATENT DOCUMENTS

| | | | |
|---|---|---|---|
| D. 23,720 | 5/1898 | La Pierre | D11/5 |
| D. 30,647 | 5/1899 | Pfeil . | |
| D. 111,135 | 9/1938 | Ebbert . | |
| D. 142,589 | 10/1945 | Pohli . | |
| D. 301,560 | 6/1989 | Gozlan . | |
| D. 320,572 | 10/1991 | Bulgari . | |
| D. 335,637 | 5/1993 | Azrielant . | |
| D. 337,739 | 7/1993 | Robbot-Tissot . | |
| 704,243 | 6/1902 | Davis | D11/5 |
| 1,672,355 | 6/1928 | Ullman | 63/1.1 |
| 2,185,811 | 1/1940 | Hayman | 63/1.1 |
| 2,242,912 | 5/1941 | Healy | 63/1.1 |
| 4,841,746 | 6/1989 | Chen . | |
| 5,115,646 | 5/1992 | Bishop . | |

FOREIGN PATENT DOCUMENTS

| | | | |
|---|---|---|---|
| 220376 | 2/1924 | United Kingdom | 63/1.1 |

OTHER PUBLICATIONS

Chas. Schwartz and Son Catalogue Date Unknown.

The Worlds Greatest Gaming Catalog Fall/Winter 1993.

*Primary Examiner*—Flemming Saether

*Attorney, Agent, or Firm*—John M. Harrison

[57] ABSTRACT

Dice and craps stick jewelry which includes a dice bracelet, a dice ring, a dice and craps stick belt buckle, a craps stick ring, a single-loop craps stick bracelet or ring, a dice and craps stick pendant, dice and craps stick earrings, a dice and craps stick tie tack, a dice and craps stick barrette, dice and craps stick shirt studs, a ring base charm bracelet, dice and craps stick cuff links, a craps stick offset ring, a dice and craps stick money clip, a dice and craps stick button cover, a dual craps stick pendant, a bezel disc craps stick pendant, a dice and craps stick charm and a craps stick pin. The dice and craps stick jewelry are each characterized by one or more miniature die attached to the dice contact leg of a miniature craps stick, the stick handle of which may be shaped in a spiral, as in the dice bracelet and dice ring or elongated, as in other dice and craps stick jewelry disclosed in the invention. Furthermore, the die or dice may be fixed or pivotally attached to the dice contact leg of the craps stick, as desired.

7 Claims, 3 Drawing Sheets

DICE AND CRAPS STICK JEWELRY

BACKGROUND OF THE INVENTION

Field of the Invention

This invention relates to jewelry and more particularly, to dice and craps stick jewelry which is characterized by various configurations and positions of a miniature decorative simulated craps stick having a stick handle and a dice contact leg projecting from one end of the stick handle in ninety-degree relationship, with a miniature die or dice pivoted or fixed to the dice contact leg and the stick handle rounded or spiralled to define a bracelet or ring, or elongated to define other jewelry. The dice and miniature decorative simulated craps stick combination is provided in a dice bracelet, a dice ring, a dice and craps stick belt buckle, a craps stick ring, a single-loop craps stick bracelet or ring, a dice and craps stick pendant, dice and craps stick earrings, a dice and craps stick tie tack, a dice and craps stick barrette, dice and craps stick shirt studs, a ring base charm bracelet, dice and craps stick cuff links, a craps stick offset ring, a dice and craps stick money clip, a dice and craps stick button cover, a dual craps stick pendant, a bezel disc craps stick pendant, a dice and craps stick charm and a craps stick pin.

Ornamental jewelry has long been constructed of various materials, shapes and sizes according to various themes, including sports and country music themes and the like. The dice and craps stick jewelry of this invention includes two of the best known elements of gambling, that is, a die or dice and the simulated craps stick in miniature, for decorative effect in a specially designed jewelry line.

Accordingly, it is an object of this invention to provide dice and craps stick jewelry of various design, which utilize one or more miniature decorative simulated craps sticks and one or more miniature die or dice in ornamental fashion to shape a dice bracelet, a dice ring, a craps stick ring, a single-loop craps stick bracelet or ring, a dice and craps stick pendant, dice and craps stick earrings, a dice and craps stick tie tack, a dice and craps stick barrette, dice and craps stick shirt studs, dice and craps stick cuff links, a craps stick offset ring, a dice and craps stick money clip, a dice and craps stick button cover, a dual craps stick pendant, a bezel disc craps stick pendant, a dice and craps stick charm and a craps stick pin.

Another object of this invention is to provide a new and ornamental dice bracelet which is characterized in a first preferred embodiment by a spiral miniature decorative, simulated craps stick handle having a projecting dice contact leg for receiving at least one die, either fixed or pivotally disposed on the dice contact leg and, in another preferred embodiment, a hinge for positioning and removing the dice bracelet on and from the arm, respectively.

Still another object of this invention is to provide a dice ring which includes a miniature decorative simulated craps stick having a spiral handle with an outwardly-extending dice contact leg having one or more die pivotally or fixedly attached to the dice contact leg, for wearing on the finger.

Yet another object of the invention is to provide a dice and craps stick belt buckle which includes a belt buckle constructed of selected material and to a selected size and at least one miniature, decorative, simulated craps stick attached to the belt buckle. At least one die is fixed or pivotally secured to the dice contact leg of the craps stick.

A still further object of this invention is to provide a craps stick ring which is characterized by a ring base fitted with a flat top to accommodate a miniature, decorative, simulated craps stick, with a pair of miniature dice attached to the dice contact leg of the craps stick.

A still further object of the invention is to provide a single-loop craps stick bracelet or ring which includes a miniature, decorative, simulated craps stick having a handle shaped to define an open ring for fitting over the hand and positioning on the arm of a wearer and a pair of miniature dice fixed or pivotally attached to the dice contact leg extending from one end of the craps stick handle.

Yet another object of this invention is to provide a dice and craps stick pendant which includes a miniature, decorative, simulated craps stick having a handle and a dice contact leg, with a pair of miniature dice fixed to or pivotally mounted on the dice contact leg and a mount ring fitted at the stick handle-dice contact leg juncture, for accommodating a necklace and wearing the dice and craps stick pendant around the neck.

Still another object of this invention is to provide dice and craps stick earrings, each of which is constructed in the same manner as the dice and craps stick pendant, but is fitted with a conventional earring post mounted on the extending end of the stick handle for extension through the pierced ear lobe, where it is secured by means of a retainer clip.

Yet another object of the invention is to provide a dice and craps stick tie tack which is also configured in the same manner as the dice and craps stick pendant and the dice and craps stick earrings, but includes a second mount ring positioned at the extending end of the stick handle for receiving one end of a tie tack chain, the other end of which chain is attached to the first mount ring and secures the dice and craps stick tie tack on the tie.

Another object of the invention is to provide a dice and craps stick barrette which is also configured in the same manner as the dice and craps stick pendant, earrings and tie tack, but further includes a barrette clip of various design for securing the dice and craps stick barrette in the hair.

Yet another object of this invention is to provide dice and craps stick shirt studs, each of which, like the dice and craps stick barrette, is configured in the same manner as the dice and craps stick pendant, dice and craps stick earrings and the dice and craps stick tie tack, but includes a tie tack base and post combination for receiving a stud pin and securing the dice and craps stick shirt stud in the button hole of a shirt.

A further object of the invention is to provide a ring base charm bracelet which includes a ring base designed in the same configuration as the craps stick ring base but without the band. A charm bracelet chain is attached to the two ends of the ring base element for wearing on the wrist.

Still another object of this invention is to provide dice and craps stick cuff links, each of which is characterized by discs of selected size and character, with a miniature, decorative, simulated craps stick secured thereto and a pair of miniature dice attached to the dice contact leg of the craps stick. Various types of attachment devices are applied to the cuff link discs for securing each cuff link disc to a shirt cuff.

A still further object of the invention is to provide a craps stick offset ring which includes a band which supports a miniature, decorative, simulated craps stick having a pair of miniature, decorative, simulated dice attached thereto.

Another object of this invention is to provide a dice and craps stick money clip which includes a money clip fitted with a miniature craps stick having a pair of miniature, decorative, simulated dice attached thereto.

A still further object of the invention is to provide a dice and craps stick button cover which includes a miniature, decorative, simulated craps stick and dice combination, the stick handle of which craps stick is attached to a button clip having a button slot for fitting over the button of a garment.

Yet another object of the invention is to provide a dual craps stick pendant characterized by a coin or disc with a pair of miniature, decorative, simulated craps sticks with miniature dice, attached thereto.

A still further object of the invention is to provide a bezel disc craps stick pendant which includes a gambling chip, coin or disc having a bezel and a single, miniature, decorative, simulated craps stick and dice attached thereto.

Another object of the invention is to provide a dice and craps stick charm which includes a miniature, decorative, simulated craps stick, the dice contact leg of which is fitted with a pair of dice and a pair of mount rings attached to the craps stick for accommodating a charm bracelet; and A final object of the invention is to provide a craps stick pin which includes a miniature, decorative, simulated craps stick and miniature dice with a post and retainer clip.

BRIEF DESCRIPTION OF THE DRAWINGS

The invention will be better understood by reference to the accompanying drawings, wherein.

DESCRIPTION OF THE PREFERRED EMBODIMENTS

Figure 1:
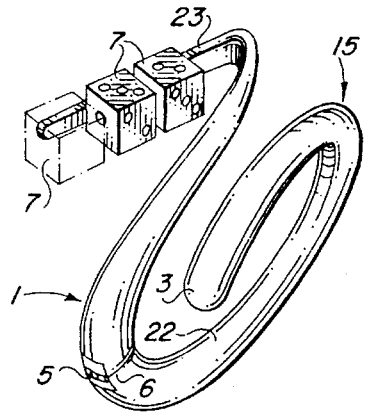
FIG. 1 is a perspective view of a preferred hinged embodiment of the dice bracelet of this invention.
Figure 2:
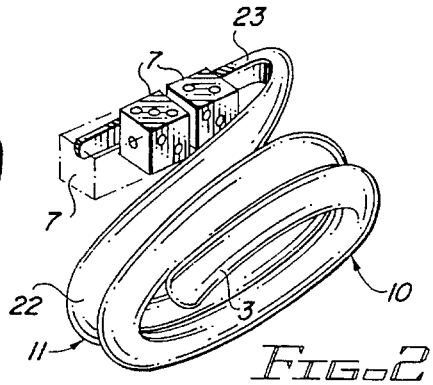
FIG. 2 is a top view of the dice bracelet illustrated in FIG. 1A.
Figure 5:
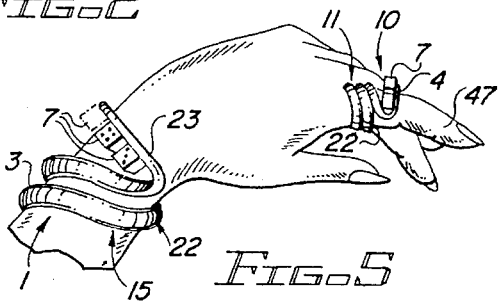
FIG. 5 is a perspective view of a preferred embodiment of the dice bracelet and dice ring mounted on the wrist and finger, respectively, of a wearer.

Referring initially to FIGS. 1 and 5 of the drawings, in a preferred embodiment of the invention a dice bracelet is generally illustrated by reference numeral 1. The dice bracelet 1 is characterized by a bracelet spiral configured from the stick handle 22 of a miniature, decorative, simulated craps stick 15, the bracelet spiral terminating at one end in a loop base 3 and at the other in a dice contact leg 23. A pair of miniature dice 7 are fixed to the dice contact leg 23 and in a preferred embodiment of the invention a self-closing, spring-loaded hinge 5 is provided in the stick handle 22 to facilitate opening the dice contact leg 23 side of the dice bracelet 1 from the loop base 3 side and slipping the dice bracelet 1 on the arm of a wearer, as illustrated in FIG. 5. Alternatively, under circumstances where the dice bracelet 1 is primarily designed for use by women, the hinge 5 is eliminated in favor of a one-piece stick handle 22, to facilitate slipping the dice bracelet 1 over the fingers and hand of the user, also to the position illustrated in FIG. 5.

Figure 1A:
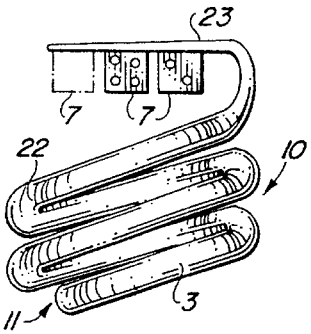
FIG. 1A is an alternative non-hinged, tighter spiral embodiment of the dice bracelet illustrated in FIG. 1.
Figure 8:
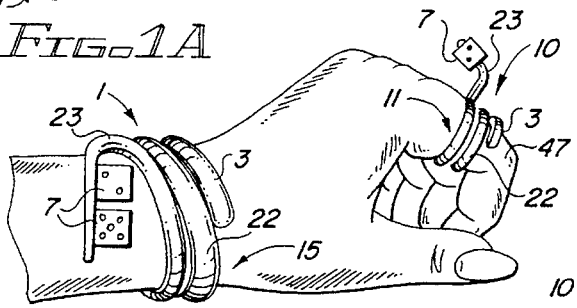
FIG. 8 is a perspective view of the craps stick ring illustrated in FIG. 6 and a preferred closed spiral embodiment of the dice bracelet, mounted on the finger and wrist, respectively, of a wearer.

Referring to FIGS. 1A and 8 of the drawings, in another preferred aspect of the dice bracelet embodiment of the invention the dice bracelet 1 is characterized by a miniature, decorative, simulated craps stick 15 having a stick handle 22 which is more tightly wound in a spiral with the loops closer together than the dice bracelet 1 illustrated in FIG. 1.

Figure 7:
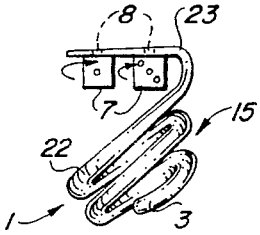
FIG. 7 is a top view of a modified version of the craps stick ring illustrated in FIG. 6, with a pair of dice rotatably attached to the dice contact leg of the spiral craps stick.

In yet another preferred embodiment of the invention, the dice bracelet 1 is configured as illustrated in FIG. 7, wherein the pair of miniature dice 7 are attached to the dice contact leg 23 of the miniature, decorative, simulated craps stick 15 by means of dice pivot pins 8, such that the dice 7 will pivot with respect to the dice contact leg 23. Although a pair of dice 7 are illustrated as mounted on the dice contact leg 23 of the dice bracelet 1, it will be appreciated, as indicated in FIG. 1, that a third or even additional dice 7 can be added to the dice contact leg 23, as illustrated in phantom in FIG. 7.

Figure 3:
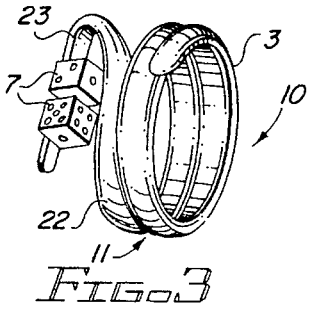
FIG. 3 is a side view of a dice ring constructed much in the same manner as the dice bracelet illustrated in FIGS. 1 and 2 and provided with a single die on the dice contact leg element of the spiral craps stick.
Figure 4:
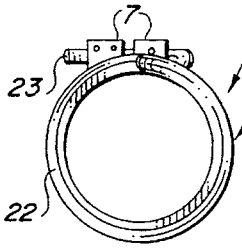
FIG. 4 is a rear view of the dice ring illustrated in FIG. 3.
Figure 6:
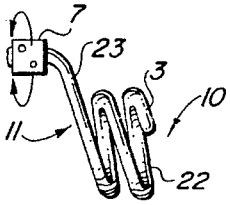
FIG. 6 is a side view of a craps stick ring fitted with a single miniature die which is mounted as a solitaire and is rotatably attached to the dice contact leg element of the miniature, decorative, simulated craps stick.

In another preferred embodiment of the invention and referring to FIGS. 3 and 4 of the drawings, a dice ring 10 is characterized by a ring loop 11, which is also shaped in the stick handle 22 element of a miniature, decorative, simulated craps stick 15, with the dice contact leg 23 extending from one end of the stick handle 22 to receive at least two, and possibly three or more dice 7, as illustrated. Accordingly, the dice ring 10 may be slipped on the ring finger 47 of the hand of a wearer as illustrated in FIG. 5, along with, or in the absence of the dice bracelet 1. As illustrated in FIGS. 6 and 7, one or more die or dice 7 can be pivotally attached to the dice contact leg 23 by means of dice pivot pins 8 (illustrated in FIG. 7), as desired.

Figure 10:
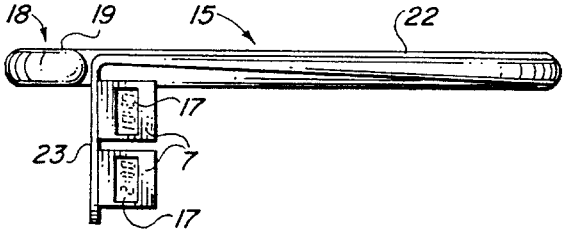
FIG. 10 is a top view of a single-loop craps stick bracelet or ring which includes a circular craps stick handle having an outwardly-extending dice contact leg, to which is mounted a pair of miniature dice that may have electronic displays therein.
Figure 11:
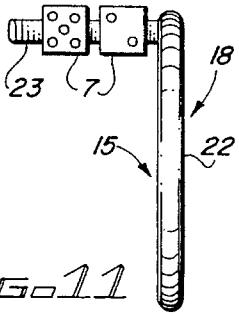
FIG. 11 is a bottom view of an alternative preferred embodiment of the single-loop craps stick bracelet or ring illustrated in FIG. 10, wherein the miniature dice are conventional in design.
Figure 12:
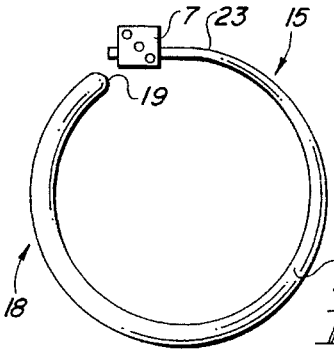
FIG. 12 is a front view of yet another alternative embodiment of the single-loop craps stick bracelet or ring, wherein a single miniature die is attached to the dice contact leg of the miniature, decorative, simulated craps stick.

Referring to FIGS. 10–12 of the drawings, in another preferred embodiment of the invention a single loop craps stick bracelet or ring 18 is detailed, and is fashioned from a miniature, decorative, simulated craps stick 15, wherein one end of the stick handle 22 terminates at the free end 19 and the miniature dice 7 are mounted on the opposite dice contact leg 23, as illustrated. At least one pair of dice 7 and preferably, an additional die 7 (illustrated in phantom) are mounted to the dice contact leg 23 and electronic displays 17 may also be provided in the dice 7 to indicate the time and date, or other displays, as desired. It will be appreciated that this feature of the dice 7 may also be applied to the die or dice 7 in the dice bracelet 1, dice ring 10, craps stick ring 13 and other elements of the dice and craps stick jewelry of this invention.

Figure 13:
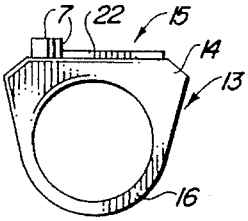
FIG. 13 is a front view of a craps stick ring which includes a flat top area, upon which is mounted a miniature craps stick and a pair of miniature dice attached to the dice contact leg of the miniature, decorative, simulated craps stick.
Figure 14:
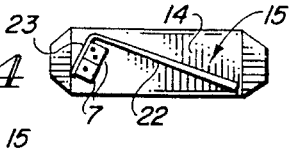
FIG. 14 is a top view of the craps stick ring illustrated in FIG. 13.

Referring now to FIGS. 13 and 14 of the drawings, in another preferred embodiment of the invention a craps stick ring 13 includes a ring base 14, configured with a band 16 and having a flat top segment for receiving a miniature, decorative, simulated craps stick 15, which includes a stick handle 22 and a dice contact leg 23 extending from one end of the stick handle 22 in ninety-degree relationship. A pair of miniature dice 7 are attached to the dice contact leg 23 in the same manner as the dice bracelet 1 and the dice ring 10, described above.

Figure 16:
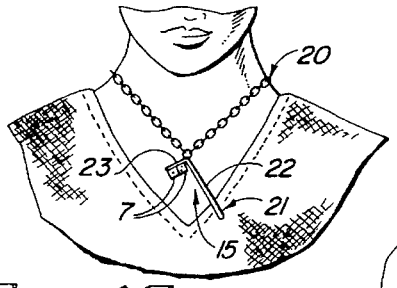
FIG. 16 is a front view of the dice and craps stick pendant illustrated in FIG. 15 in functional position suspended on a necklace around the neck of a wearer.
Figure 15:
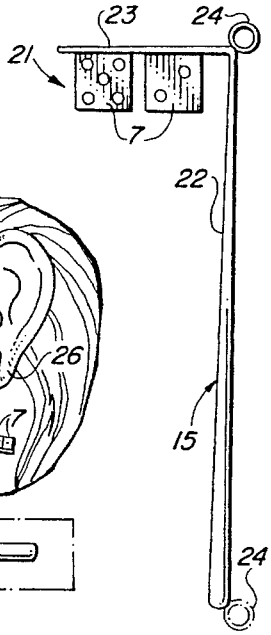
FIG. 15 is a front view of a dice and craps stick pendant having a mount ring in a selected location for wearing on a conventional necklace.

Referring now to FIGS. 15 and 16 of the drawings, in yet another preferred embodiment of the invention a dice and craps stick pendant 21 is shown mounted on a necklace 20 as illustrated in FIG. 16, by means of a mount ring 24, located at the junction between the stick handle 22 and the dice contact leg 23 of the miniature, decorative, simulated craps stick 15. A pair of miniature dice 17 are mounted on the dice contact leg 23, as heretofore described.

Figure 17:
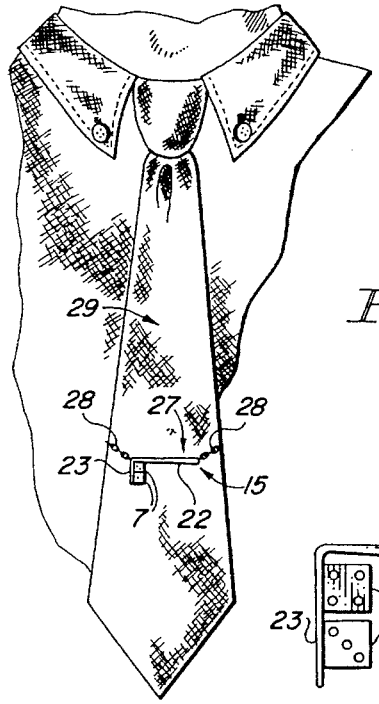
FIG. 17 is a front view of a dice and craps stick tie tack mounted on a tie tack chain in functional position on a tie.

Referring to FIG. 17 of the drawings, a dice and craps stick tie tack 27 is illustrated, and is also configured in the same manner as the dice and craps stick pendant 21, illustrated in FIG. 15, but includes an additional mount ring 24, located on the extending end of the stick handle 22, as well as the mount ring 24 attached to the juncture between the stick handle 22 and the dice contact leg 23 of the miniature, decorative, simulated craps stick 15, to accommodate a tie tack chain 28, which extends around a conventional tie 29 and attaches to both the mount rings 24, as illustrated.

Figure 18:
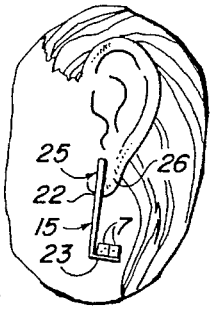
FIG. 18 is a front view of a dice and craps stick earring mounted in functional configuration on the pierced earlobe of a wearer.

Referring now to FIG. 18 of the drawings, a disc and craps stick earring 25 is detailed, which earring is configured in the same shape as the dice and craps stick pendant 21 and is fitted with a conventional post and retainer (not illustrated) for attachment of the dice and craps stick earring 25 to the pierced ear lobe 26 of a wearer, in conventional fashion.

Figure 19:
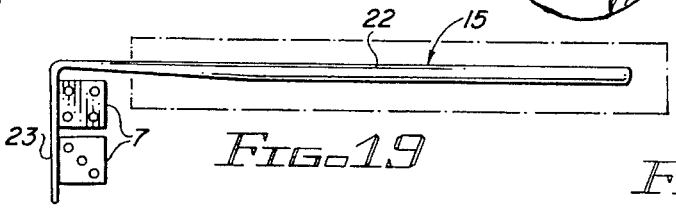
FIG. 19 is a top view of a miniature dice and craps stick combination from which the dice and craps stick jewelry of this invention is constructed.
Figure 19C:
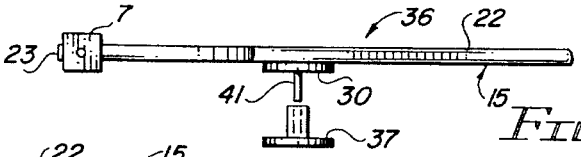
FIG. 19C is a side view of a dice and craps stick shirt stud fitted with a tie tack base, post and stud pin for attachment to the button hole of a formal shirt.
Figure 19A:
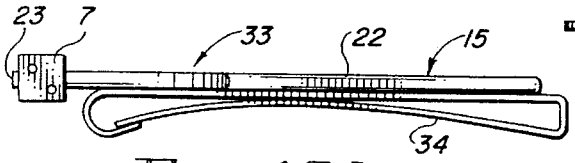
FIG. 19A is a side view of a dice and craps stick barrette having a spring-type barrette clip.
Figure 19D:
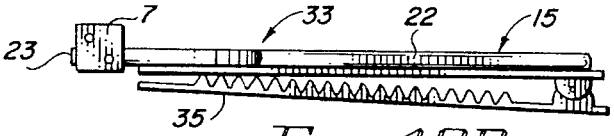
FIG. 19D is a side view of another embodiment of the dice and craps stick barrette, with an alternative saw tooth clip.
Figure 19B:
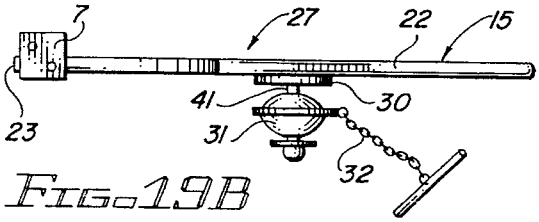
FIG. 19B is a side view of a dice and craps stick tie tack having a tie tack base and a post fitted with a retainer clip for attachment to a tie.

Referring to FIG. 19 of the drawings, the miniature, decorative, simulated craps stick 15, having an elongated stick handle 22 and offset dice contact leg 23 in a craps stick 15 is illustrated, wherein the dice contact leg 23 is fitted with a pair of miniature dice 7, as in other embodiments of the invention. The miniature, decorative, simulated craps stick 15 can be utilized in the construction of additional jewelry as follows: Referring to FIG. 19A, a spring-type barrette clip 34 is secured to the stick handle 22 of the craps stick 15 to define a dice and craps stick barrette 33. Another dice and craps stick barrette 33 is constructed by securing a saw tooth clip 35 to the stick handle 22 of the craps stick 15, for mounting in the hair in the same manner as the barrette clip 34, as illustrated in FIG. 19D. Similarly, referring to FIG. 19B, a tie tack base 30 can be attached to the elongated stick handle 22 of the miniature craps stick 15 to define a dice and craps stick tie tack 27, wherein a retainer clip 31 is attached to the disc post 41 element of the tie tack base 30. A tie tack chain 32 is also attached to the retainer clip 31 for attachment to a shirt button hole as security for the dice and craps stick tie tack 27. Furthermore, as illustrated in FIG. 19C, the disc post 41 extending from the tie tack base 30 is designed to removably receive a stud pin 37 for fitting in the button hole of a shirt (not illustrated) and securing a dice and craps stick shirt stud 36 to the shirt in the likeness of the miniature craps stick 15.

Figure 20:
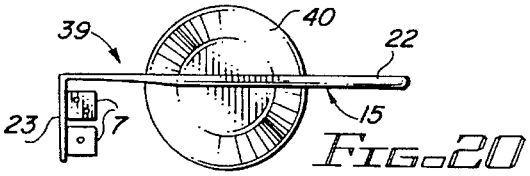
FIG. 20 is a front view of a dice and craps stick cuff link having a cuff link disc and provided with a miniature, decorative, simulated craps stick with a pair of miniature dice attached to the dice contact leg of the craps stick.
Figure 20D:
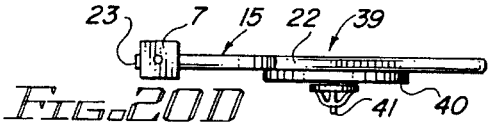
FIG. 20D is a side view of a dice and craps stick lapel pin.
Figure 20B:
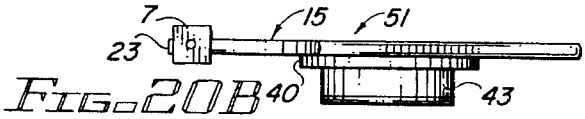
FIG. 20B is a top view of a dice and craps stick button cover with a button clip for attachment to a button of a shirt.
Figure 20C:
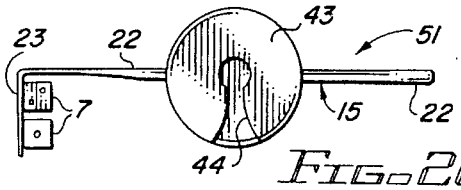
FIG. 20C is a rear view of the dice and craps stick button cover illustrated in FIG. 20B, particularly illustrating the button slot fitted in the button clip for attachment to a button.
Figure 20A:
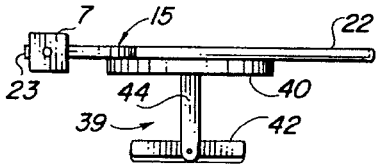
FIG. 20A is a side view of the dice and craps stick cuff link illustrated in FIG. 20, more particularly illustrating the conventional disc post and pivot arm combination for attachment of the cuff link to the respective cuffs of a shirt.

Referring to FIGS. 20 and 20A of the drawings, a dice and craps stick cuff link 39 is illustrated and is characterized by a cuff link disc 40, provided with a disc post 41, as illustrated in FIG. 20A. A pivot arm 42 is pivotally attached to the disc post 41 for attachment of the cuff link disc 40 to the cuffs of a shirt in conventional fashion. The elongated stick handle 22 of a miniature, decorative, simulated craps stick 15 is attached to the top surface of the cuff link disc 40 and the dice contact leg 23 carries a pair of miniature dice 7.

Similarly, referring to FIGS. 20B and 20C of the drawings, the button clip 43 of a dice and craps stick button cover 51 is secured to the stick handle 22 of the miniature, decorative, simulated craps stick 15 and includes a button slot 44 for attachment to the button of a shirt, in displaying the craps stick 15, with the miniature dice 7 attached to the dice contact leg 23, on the shirt.

Figure 29:
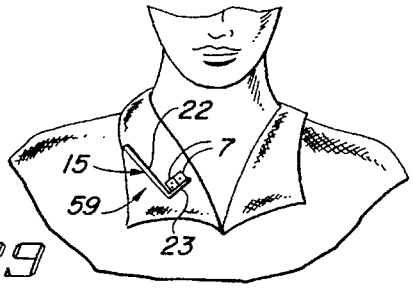
FIG. 29 is a dice and craps stick pin constructed in the same manner as the dice and craps stick charm, but having a conventional post and clip as illustrated in FIG. 20D, extending from the stick handle element of the craps stick for attachment of the craps stick pin to the lapel of a shirt, as illustrated.

As illustrated in FIG. 20D, a disc post 41 is attached to the cuff link disc 40 and receives a retainer clip 41 to convert the dice and craps stick cuff link 39 to a lapel pin, such as the craps stick pin 59, illustrated in FIG. 29.

Figure 21:
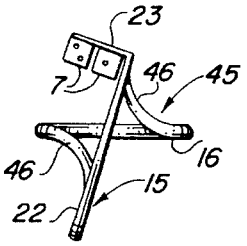
FIG. 21 is a top view of a craps stick offset ring which is characterized by a miniature, decorative, simulated craps stick, wherein the craps stick handle is secured to the ring band by a pair of stick mounts and a pair of miniature dice is attached to the dice contact leg extending from one end of the stick handle.
Figure 22:
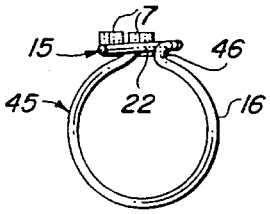
FIG. 22 is a front view of the craps stick offset ring illustrated in FIG. 21.
Figure 23:
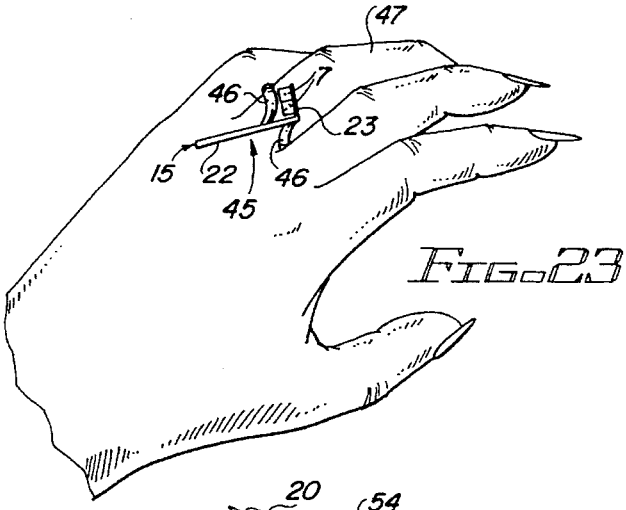
FIG. 23 is a perspective view of the craps stick offset ring in functional configuration on the ring finger of a wearer.

Referring now to FIGS. 21 and 22 of the drawings, a craps stick offset ring 45 is illustrated and also includes a miniature,decorative, simulated craps stick 15, wherein the stick handle 22 of the craps stick 15 is attached by means of stick mounts 46 to the band 16 of the craps stick offset ring 45. A pair of miniature dice 7 are attached to the dice contact leg 23 of the craps stick 15, which is heretofore described with respect to other items of jewelry. Referring to FIG. 23 of the drawings, the craps stick offset ring 45 is displayed on the ring finger 47 of the wearer.

Figure 24:
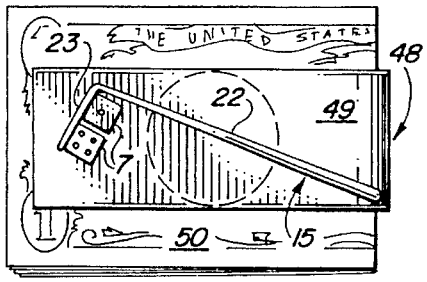
FIG. 24 is a top view of a dice and craps stick money clip with a miniature, decorative, simulated craps stick attached to the money clip and miniature dice mounted on the dice contact leg of the craps stick.
Figure 25:
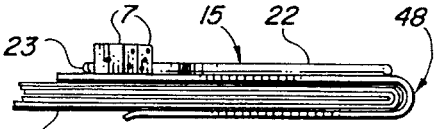
FIG. 25 is a side view of the dice and craps stick money clip illustrated in FIG. 24.

Referring now to FIGS. 24 and 25 of the drawings, a dice and craps stick money clip 48 is illustrated, with a facsimile of the miniature, decorative, simulated craps stick 15 attached to the top of the clip base 49 and a pair of miniature dice 7 attached to the dice contact leg 23 of the craps stick 15, as hereinafter described. Bills 50 are secured in the dice and craps stick money clip 48 in conventional fashion.

Figure 26:
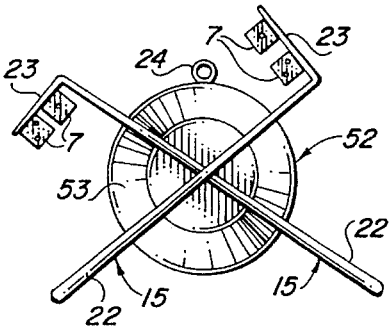
FIG. 26 is a front view of a dual craps stick pendant having a pendant gambling chip, disc or coin, to which is attached a pair of crossed miniature, decorative, simulated craps sticks, each fitted with a pair of miniature dice on the extending dice contact legs thereof.

Referring now to FIG. 26 of the drawings, a dual craps stick pendant 52 is detailed and is characterized by a pendant chip 53, to which is attached a pair of crossed miniature, decorative, simulated craps sticks 15, each having a pair of miniature dice 7 attached to corresponding dice contact legs 23. The dual craps stick pendant 52 can be worn in the same manner as the dice and craps stick pendant 21 illustrated in FIG. 16, by means of a conventional necklace 20, which is extended through the mount ring 24.

Figure 27:
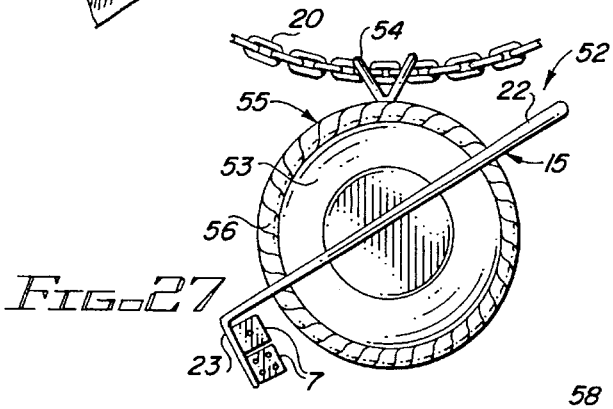
FIG. 27 is a front view of a bezel disc craps stick pendant mounted on a conventional necklace and provided with a single miniature, decorative, simulated craps stick attached to an underlying pendant gambling chip, disc or coin encircled by a bezel, which craps stick includes a pair of miniature dice attached to the dice contact leg of the craps stick.

Referring to FIG. 27 of the drawings, a bezel disc craps stick pendant 55 is detailed, wherein a pendant chip 53 is fitted with a peripheral decorative bezel 56 and the stick handle 22 of a single miniature, decorative, simulated craps stick 15 is attached to the pendant chip 53. The bezel disc craps stick pendant 55 is suspended from a conventional necklace 20 by means of a decorative bracket 54.

Figure 28:
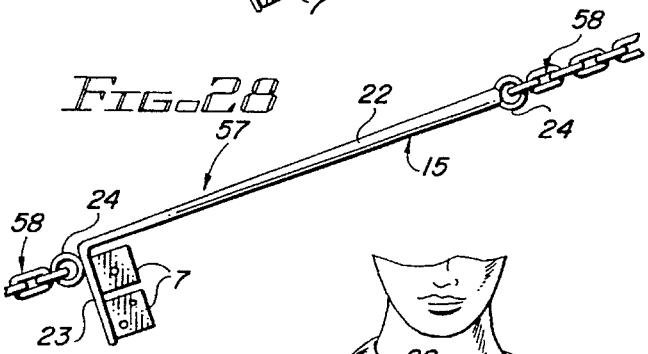
FIG. 28 is a top view, partially in section, of a dice and craps stick charm which is constructed much in the same manner as the dice and craps stick pendant and is likewise fitted with a pair of mount rings 24, for attachment to a charm bracelet chain.

Referring next to FIG. 28 of the drawings, a dice and craps stick charm 57 is illustrated and is configured in the same manner as the craps stick 15 illustrated in FIG. 19, but includes a pair of mount rings 24, mounted on the extreme ends of the stick handle 22, as in the case of the dice and craps stick pendant 21, illustrated in FIG. 15. Each of the mount rings 24 is attached to one end of a charm bracelet chain 58, as further illustrated in FIG. 28. Alternatively, a single mount ring 24 can be attached to the craps stick 15 at any desired location and the dice and craps stick charm suspended with other charms (not illustrated) from the charm bracelet chain 58.

Referring to FIG. 29 of the drawings, a craps stick pin 59 is designed in the same manner as the craps stick 15 illustrated in FIG. 19 and, like the converted dice and craps stick cuff link 39 illustrated in FIG. 20D, includes a disc post 41 and a retainer clip 31 having the same construction as the disc post 41 and retainer clip 31 illustrated in FIG. 20D. Accordingly, the craps stick pin 59 can be attached to the lapel of a shirt or dress, as illustrated in FIG. 29.

Figure 30:
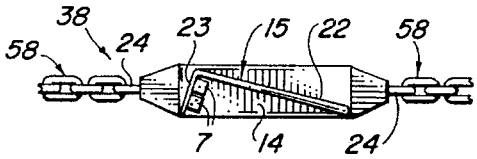
FIG. 30 is a top view, partially in section, of a ring base charm bracelet which incorporates the ring base of the craps stick ring illustrated in FIGS. 13 and 14.
Figure 31:
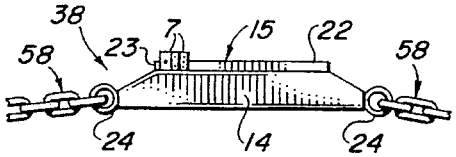
FIG. 31 is a side view, partially in section, of the ring base charm bracelet illustrated in FIG. 30.

As illustrated in FIGS. 30 and 31 of the drawings, the ring base 14 of the craps stick ring 13, illustrated in FIGS. 13 and 14, is modified by removing the band 16 and adding a pair of mount rings 24 to define a ring base charm bracelet 38 and facilitate attachment of the charm bracelet chain 58. The ring base charm bracelet 38 can then be worn on the wrist in the same manner as the dice and craps stick charm 57, illustrated in FIG. 28.

Figure 32:
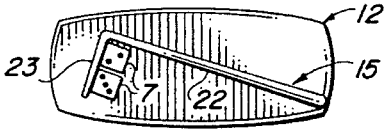
FIG. 32 is a front view of a dice and craps stick belt buckle characterized by a belt buckle having a miniature, decorative, simulated craps stick and pair of dice therein.

FIG. 32 illustrates a die and craps stick belt buckle 12 constructed of metal such as pewter, brass or any other desired material and fitted with a miniature, decorative, simulated craps stick 15, having a pair of miniature dice 7 attached to the dice contact leg 23 thereof. The belt buckle 12 can be of any desired size.

Figure 9:
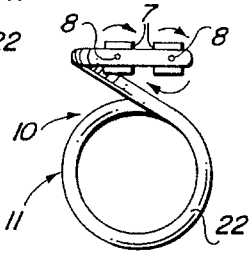
FIG. 9 is a front view of the craps stick ring illustrated in FIG. 7.

It will be appreciated by those skilled in the art that various numbers of miniature die or dice 7 can be mounted on each of the respective dice contact legs 23 of the miniature, decorative, simulated craps stick 15 element of the dice and craps stick jewelry of this invention. Furthermore, the die or dice 7 can be pivotally secured to the respective dice contact legs 23 as illustrated in FIGS. 6, 7 and 9, or fixed to the dice contact legs 23 by welding, gluing or other techniques known to those skilled in the art, as illustrated in FIG. 19. Moreover, the respective miniature, decorative, simulated craps stick 15 and dice 7 may be of any selected size, and under circumstances where the stick handle 22 of the craps stick 15 is spiralled or rounded as illustrated in FIGS. 1–9, the size of the defined opening can be varied to accommodate various wrist and finger sizes.

It will be further appreciated by those skilled in the art that the dice and craps stick jewelry of this invention, in all of the above described embodiments, may be constructed of classic jewelry material, including gold, silver, platinum and the like. Less expensive replicas can be constructed of such materials as plastic, bone, wood, mother of pearl and other suitable materials. Furthermore, both precious and semi-precious gemstones can be added, as desired.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. Dice and craps stick jewelry for wearing on display, comprising at least one miniature, decorative simulated craps stick having a dice contact leg and a stick handle extending from said dice contact leg, at least one miniature die attached to said dice contact leg of said craps stick; and attachment means provided on said miniature craps stick for maintaining said craps stick and said die on display.

2. The dice and craps stick jewelry of claim 1 wherein said craps stick and said die are designed for said wearing on display on an article of clothing and said attachment means comprises a post carried by said craps stick and a retainer clip removably attached to said post for retaining said craps stick and said die on the article of clothing responsive to extending said post through the article of clothing and engaging said post by said retainer clip.

3. The dice and craps stick jewelry of claim 1 wherein said craps stick and said die are suspended from a chain with said attachment means engaging the chain.

4. The dice and craps stick jewelry of claim 1 wherein said at least one loop comprises a spiral defining a plurality of loops and said craps stick and said die define a bracelet and a ring.

5. The dice and craps stick jewelry of claim 1 comprising hinge means provided in said loop for selectively opening and closing said loop in said craps stick to accommodate said wearing on display.

6. The dice and craps stick jewelry of claim 1 wherein said die is fixed to said dice contact leg of said craps stick.

7. The dice and craps stick jewelry of claim 1 wherein said die is pivotally attached to said dice contact leg of said craps stick.

* * * * *